US008622532B2

(12) United States Patent
Wayman et al.

(10) Patent No.: US 8,622,532 B2
(45) Date of Patent: Jan. 7, 2014

(54) METHOD AND SYSTEM FOR CLOG DETECTION AND MITIGATION IN DELIVERING SOLID-INK PELLETS TO AN IMAGING APPARATUS

(75) Inventors: William H. Wayman, Ontario, NY (US); Michael Brundige, Rochester, NY (US); David B. Playfair, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/103,468

(22) Filed: May 9, 2011

(65) Prior Publication Data

US 2012/0287210 A1 Nov. 15, 2012

(51) Int. Cl.
*B41J 2/175* (2006.01)

(52) U.S. Cl.
USPC ..... 347/88; 347/99; 347/100

(58) Field of Classification Search
USPC ..... 347/6, 9, 14, 19, 17, 84–85, 88, 99, 100
See application file for complete search history.

(56) References Cited

U.S. PATENT DOCUMENTS 4,943,818 A * 7/1990 Hotomi ..... 347/55

FOREIGN PATENT DOCUMENTS

JP 401171905 A * 7/1989 ..... 264/142

* cited by examiner

*Primary Examiner* — Juanita D Jackson
(74) *Attorney, Agent, or Firm* — Joseph E. Root

(57) ABSTRACT

Apparatus and methods for maintaining flowability of solid-ink pellets when delivering solid-ink pellets from a container to an image-forming apparatus. The apparatus includes an extraction tube inserted into the container and connected to a vacuum source. Suction from the vacuum source impels pellets into the extraction tube through an extraction inlet, but pellet agglomerations may clog the system. Such a clog produces an immediate pressure spike within the extraction tube, an event detected by the clog detector. An actuator, responsive to the clog detector, drives an agitating structure that breaks up agglomerations and restores smooth pellet flow. Alternative embodiments can include devices having only the clog detector or the agitating structure. Alternative implementations of the agitating structure provide means for accomplishing pellet break up. The accompanying method detects the occurrence of a clog and responds by operating the agitating structure to break up agglomerations.

18 Claims, 7 Drawing Sheets

METHOD AND SYSTEM FOR CLOG DETECTION AND MITIGATION IN DELIVERING SOLID-INK PELLETS TO AN IMAGING APPARATUS

TECHNICAL FIELD

The presently disclosed embodiments relate to delivery of solid-ink pellets to an image-forming apparatus, and more particularly to devices that maintain flowability of solid-ink pellets during delivery.

BACKGROUND

An image-forming apparatus employing solid-ink pellets, such as a printer, a fax machine, or a photocopier, includes a system for extracting pellets from a container for delivery to the image-forming apparatus. Conventionally, the solid ink pellets are placed in a container, and a feeding mechanism extracts the pellets and transports them to a heater assembly. There, the heater melts the pellets and a feeding mechanism applies the resulting liquid to media to form images.

In general, solid-ink pellets are stored in a container, from which pellets are extracted for print production as required. Typically, an extraction tube is inserted into the container, suction is applied to the extraction tube, and the resulting airflow entrains the solid-ink pellets from an extraction inlet in the extraction tube.

A flow problem can arise, however, when pellets bridge or clump together. This process, known as agglomeration, can occur when the pellets are stored in the container, as adjacent particles tend to fuse together under the combined action of temperature and pressure. Also, static charges on individual particles can cause attraction between adjacent particles, leading to agglomerations. Further, the prilling process employed to manufacture the solid-ink pellets can result in the pellets being brought into close proximity before they have cooled, likewise leading to agglomerations. The resulting clumps or agglomerations may exceed the size of the extraction inlet, clogging the flow of the solid-ink pellets.

Known approaches to this problem aim to break up the bridges and clumps, employing a variety of mechanical means. Generally, these solutions adapt the extraction tube to provide a device that manually agitates the solid-ink pellets to break up the agglomerations. This manual agitation must be performed sufficiently often to maintain the desired flow of solid-ink pellets. Where a number of agglomerations have formed, significant operator intervention may be required. Moreover, the agitation process itself interrupts pellet movement, and it often fails to produce the pellet movement once clumps have clogged the system.

In general, containers store considerable volumes of solid-ink pellets, and manually agitating the container may be cumbersome. In another alternative solution, mixers or grinders are coupled to the container to break obstructions. Current solutions, however, limit the breakage of agglomerates to positions near the extraction tube, thereby reducing both the efficiency of the breakage mechanism as well as the flowability of the solid-ink pellets.

It would be highly desirable to have a simple and cost-effective system that identifies an appropriate time for agitating pellet agglomerations, and further maintains flowability of solid ink-pellets from a container, breaking up clumps and agglomerates.

SUMMARY

One embodiment of the present disclosure provides an apparatus for maintaining flowability of solid-ink pellets during suction-induced flow from a container to an image-forming device. The apparatus employs an extraction tube attached to a vacuum source, with an end of the extraction tube being inserted into the container for receiving pellets. Further, the apparatus includes a clog detector for sensing changes in vacuum level within the extraction tube to identify clogging. Based on the identification of the pellet agglomerations, an agitating structure breaks up pellet agglomerations Another embodiment of the present disclosure provides an apparatus for maintaining flowability of solid-ink pellets during suction-induced flow from a container to an image-forming device, employing a clog detector. The apparatus employs an extraction tube attached to a vacuum source, with an end of the extraction tube being inserted into the container for receiving pellets. Further, the apparatus includes a clog detector for sensing changes in vacuum level within the extraction tube to identify clogging.

A further embodiment of the present disclosure provides an apparatus for maintaining flowability of solid-ink pellets during suction-induced flow from a container to an image-forming device, incorporating apparatus to break up pellet agglomerations. The apparatus employs an extraction tube attached to a vacuum source, with an end of the extraction tube being inserted into the container for receiving pellets. Further, the apparatus includes an agitating structure to break up pellet agglomerations Another embodiment discloses a method for maintaining flowability of solid-ink pellets during flow from a container to an image-forming device. The method involves inducing a suction force through an extraction tube for pellet extraction. The method further involves transporting the pellets from the container to an assist tube, through inlet holes of the assist tube, the assist tube being inside the container. In addition, the method includes detection of clogging, followed by agitation of the pellet agglomerations to undergo breakage. Pellets are transferred from the assist tube to the image-forming device through the extraction tube.

DETAILED DESCRIPTION

The following detailed description is made with reference to the figures. Preferred embodiments are described to illustrate the disclosure, not to limit its scope, which is defined by the claims. Those of ordinary skill in the art will recognize a number of equivalent variations in the description that follows.

As used herein, the term "tube" includes any generally elongated device enclosing a lengthwise passage, suitable for conveying fluid or particulates. As thus defined, a tube may be formed of any suitable material and in any suitable cross-section.

Overview

The present disclosure describes various embodiments of a system and a method for maintaining flowability of solid-ink pellets during delivery to an image-forming device. The solid-ink pellets are stored in a container, and an extraction tube extends into the container for receiving the pellets. One end of the tube extends to the vicinity of the container bottom and the other end extends at least above the top, or lid, of the container. A vacuum source applies suction to the end of the vacuum tube to produce an airflow through the tube, entraining pellets in the airflow and moving them to the image-forming device. In the event that obstructions interfere with the smooth flow of pellets, a clog detector connected to the extraction tube senses a pressure spike. The system then activates an agitating structure, which can take any of a number of alternative constructions. The resulting agitation breaks up the pellet agglomerations to eliminate clogging, and airflow resumes, restoring a smooth extraction of pellets from the container.

Conventional Delivery System

Figure 1:
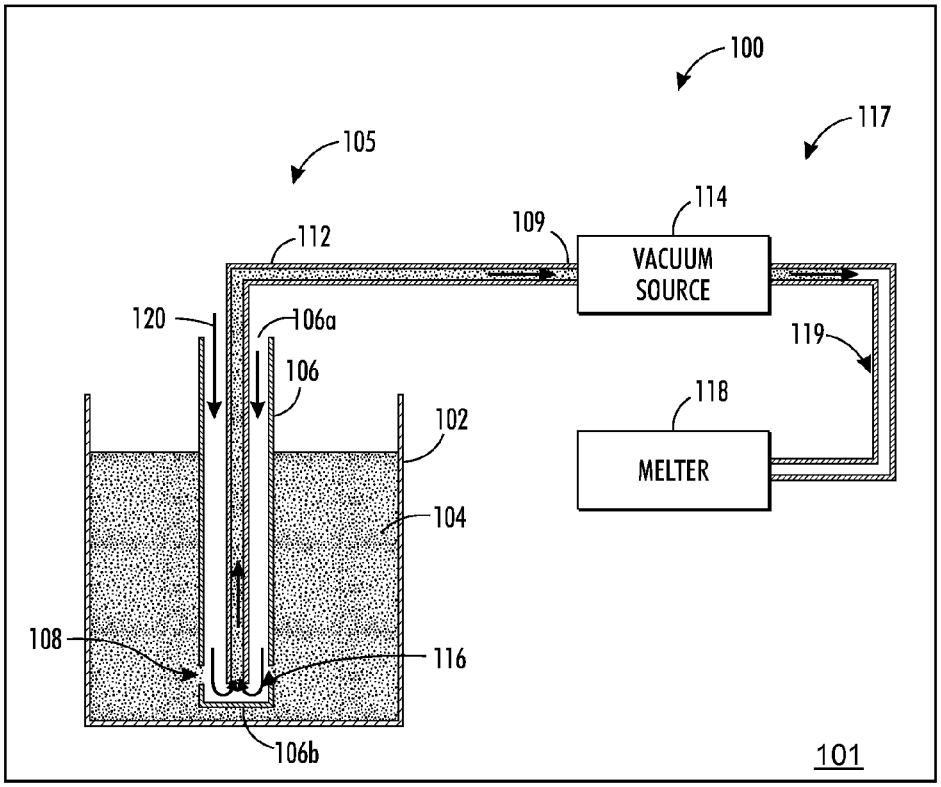
FIG. 1 PRIOR ART
FIG. 1 illustrates a conventional solution for providing solid-ink pellet delivery to an image-forming device.

FIG. 1 illustrates a conventional delivery system 100 for supplying solid-ink pellets to an image-forming device 101. Delivery system 100 includes a container 102, an extraction assembly 105, and a delivery assembly 117. Container 102 is adapted to receive and store solid-ink pellets 104. Container 102 is generally cylindrical and is typically sized to store 50-60 gallons of solid-ink pellets 104. The top of container 102 can remain open, or it can be either closed, by a lid or by a special top adapted as explained below (neither type of lid shown). Both container 102 and the lid, if any, can be formed from convenient materials, such as plastic. It should be noted that in the interest of clarity, image-forming device 101 will not be shown below but will be understood to be present.

Extraction assembly 105 provides a path by which solid-ink pellets 104 can flow from container 102, and it includes an assist tube 106 and an extraction tube 112. Assist tube 106 is generally rigid and tubular, having an open end 106*a*, a closed end 106*b*, and a number of inlet holes 108 passing through the sides of assist tube 106 near closed end 106*b*. This structure stands vertically in container 102, supported either by a convenient structure (not shown), such as struts, extending to the sides of container 102, or by an opening formed in a lid or cover (not shown) provided atop container 102. As shown, assist tube 106 extends to the vicinity of container 102 bottom. Extraction tube 112 is carried within assist tube 106, with an extraction inlet 116 at the tip of extraction tube 112, extending to the vicinity of closed end 106*b*. The portion of this tube lying within assist tube 106 is generally rigid, and it is carried within assist tube 106, supported by convenient means (not shown). The sizing of assist tube 106, extraction tube 112, and inlet holes 108 is based on the sizing of solid-ink pellets 104, as discussed below. It should be noted that the extraction inlet 116 of the illustrated embodiment is defined by the tip of the extraction tube, but that inlet can be formed as desired in the extraction tube, based on the need to provide a convenient and effective entrance for the pellets to enter the extraction tube.

Delivery assembly 117 provides both the motive means and the destination for the flow of solid-ink pellets. Components of delivery assembly 117 include a vacuum source 114 and a melter 118. Vacuum source 114 is a source of suction, such as an air pump, connected to a downstream end 109 of extraction tube 112. A similar tube 119 extends from vacuum source 114 to melter 118, the latter being a conventional component of imaging devices employing solid-ink pellets.

In operation, vacuum source 114 applies suction to extraction tube 112, inducing a longitudinal airflow 120 in assist tube 106. This flow produces suction at inlet holes 108, impelling individual pellets 104 to become entrained in airflow 120 within extraction tube 112. Pellets 104 proceed to vacuum source 114 and on to melter 118.

For purposes of description, the present disclosure is described in connection with solid-ink pellets. Those skilled in the art, however, will appreciate that other environments may similarly require delivery of solid-ink pellets for printing or other purposes, from a storage container or similar device. The technology set out here can also be employed to promote flowability of solid particulates and pellets in a variety of other environments.

That delivery system encounters difficulties when solid-ink pellets 104 have agglomerated, as described above. Then, the agglomerations (also referred to as clumps, arches, or bridges) either cannot pass through inlet holes 108 or they cannot enter extraction inlet 116, depending on the size of the agglomerations. Experience has shown that the most likely clogging point is extraction inlet 116.

Exemplary Embodiments

Figure 2:
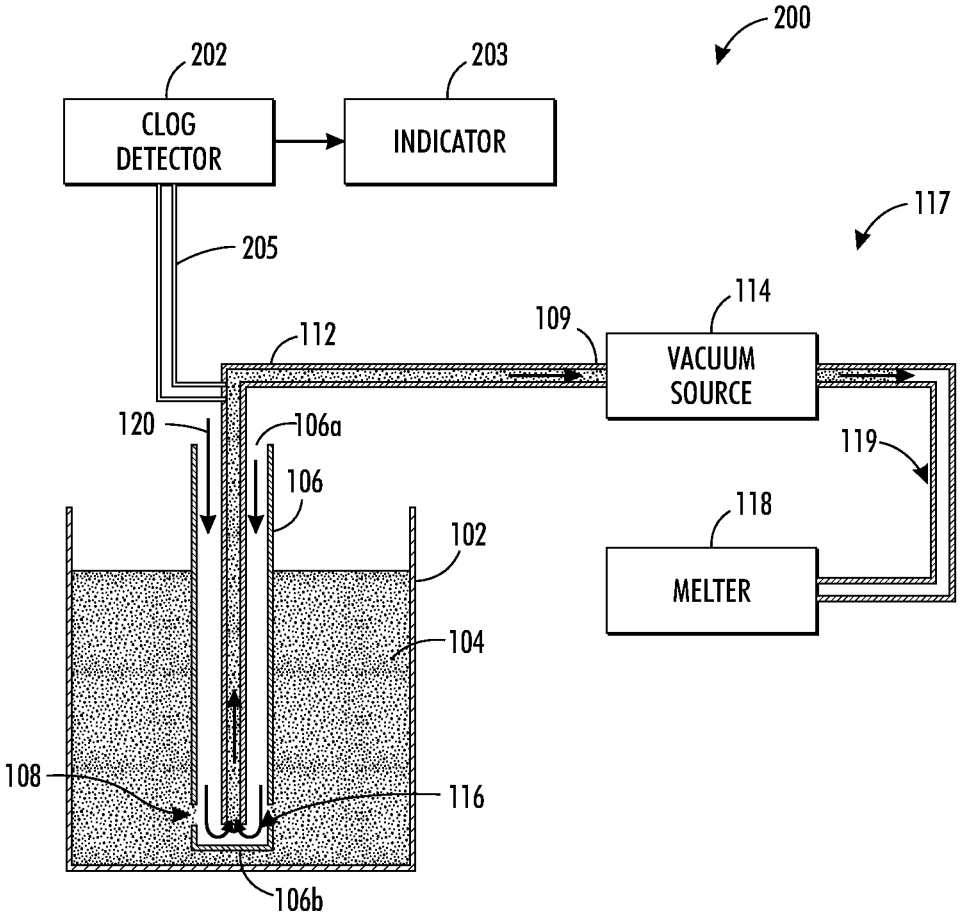
FIG. 2 illustrates an exemplary system for delivering a continuous flow solid-ink pellets to an image-forming device.

FIG. 2 schematically illustrates an exemplary system 200 for delivering an uninterrupted flow of solid-ink pellets 104 to an image-forming device (not shown). System 200 employs a number of components identical to those discussed in connection with FIG. 1, such as assist tube 106, extraction tube 112, and vacuum source 114. Those components are similar in structure and operation to those shown in FIG. 1. In addition, system 200 includes a clog detector 202 for identifying clogs.

In adapting the structure of FIG. 1, however, it should be noted that particular care is exercised to design a structure that minimizes the possibility of clogs. For example, components are sized to maximize pellet flow. Solid-ink pellets 104 are generally between about 1 mm in 3 mm in diameter, most often about 2 mm, and system components are sized to accommodate those pellets. Thus, inlet holes 108 are generally larger than the individual pellets 104, so that some agglomerates will pass through those holes. The diameter of assist tube 106, and the size of the gap between assist tube 106 and extraction tube 112, as well as the diameter of extraction inlet 116, are all planned with a view to maximize pellet flow and minimize the possibility of clogging. For example, the inside diameter of associated fittings of extraction tube 112, as well as associated fittings and flexible tubing, at a constant or increasing diameter, never decreasing. That measure minimizes or eliminates pinch points.

Clog detector 202 identifies clogging within extraction tube 112 by sensing pressure changes. Thus, input to clog detector 202 is a pressure line 205 connected to extraction tube 112 at some point above assist tube 106, but upstream of vacuum source 114. The output of clog detector 202 is some indication that a clog exists, which can be provided by any known means, such as an indicator light 203 or the automated means discussed below. Those of skill in the art will appreciate that a wide range of conventional and readily available devices can be employed to provide clog detector 202. Primarily, the device must be able to sense changes in pressure and indicate that fact. Thus, suitable devices would include a pressure switch or a vacuum switch, all well within the knowledge of those in the art.

Clog detector 202 operates by sensing the pressure spike that normally accompanies a blockage. During normal operation, vacuum pressure within extraction tube 112 remains relatively constant. Solid-ink pellets 104 flow smoothly into assist tube 106, where they become entrained in airflow 120 and proceed through extraction tube 112. If agglomerate forms near extraction inlet 116, however, vacuum pressure within extraction tube 112 immediately spikes, in a manner directly analogous to blocking the entry nozzle of a home vacuum cleaner. Clog detector 202 senses that condition and communicates it to the operator by illuminating indicator light 203.

As will be appreciated by those in the art, clog detector 202 can be any device that responds to events that accompany a clog. As noted, a pressure sensor or vacuum switch performs these functions and are clear choices for this component. Devices that sense airflow would also suffice, given that a decreasing airflow occurs following a clog. The latter class of devices is generally more expensive than simple pressure sensors, but airflow monitors may be preferred in certain situations. Of the devices, now known or hereafter developed, as known to those in the art can be substituted as desired.

Alternatives and variations of the disclosed structure will be apparent to those of skill in the art. On the macro scale, it will be recognized that the principles of the present disclosure apply generally to systems in which pelletized solids or particulates must be delivered from one point to another. Similarly, the material, construction, and sizing of disclosed components may be varied as desired to suit particular applications.

System 200 improves upon the operation of the conventional device of FIG. 1 by providing a capability to identify clogs. By itself, however, clog detector 202 cannot remove the agglomerates clogging the system. To accomplish that result, an agitating structure is required. Clogs generally form in two places—at extraction inlet 116 or in the vicinity of inlet holes 108, and thus an effective agitating structure must be positioned to break up agglomerates in both areas. As disclosed below, FIGS. 3-6 set out specific embodiments of agitating structures aimed at both locations.

Figure 3:
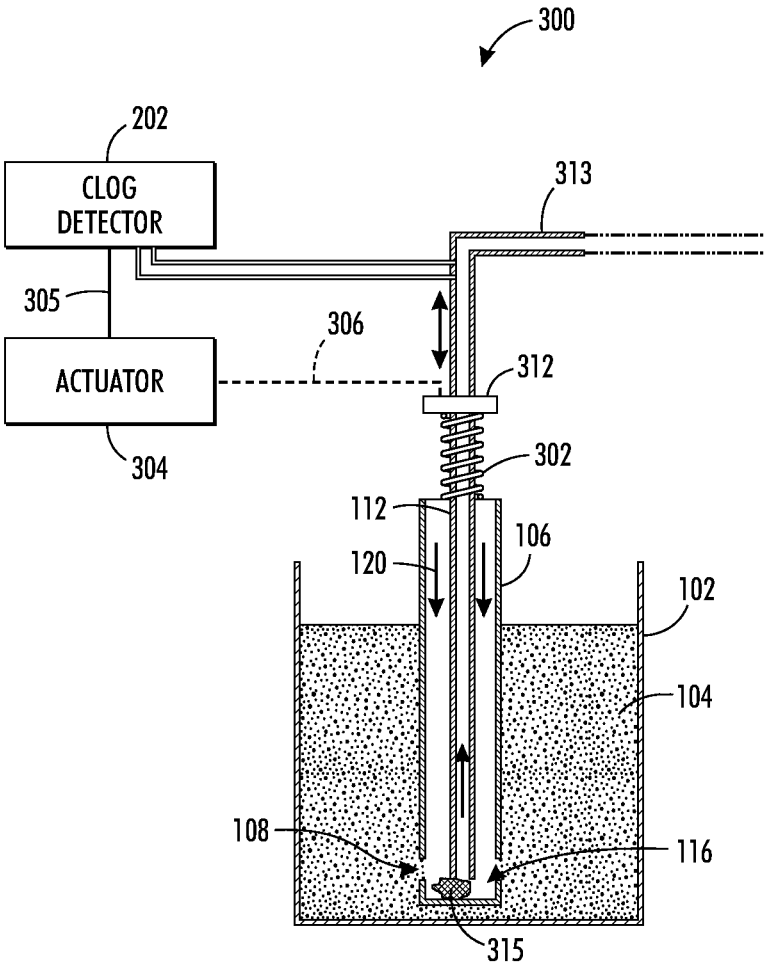
FIG. 3 shows an embodiment of an agitating system including a spring, according to the present disclosure.

FIG. 3 illustrates an agitating structure 300 designed to break up agglomerations near extraction inlet 116. This embodiment adds to the structure of FIG. 2 by providing a spring-loaded agitating mechanism 312 mounted on extraction tube 112 and operated by an actuator 304. In terms of operation through the point of detecting a clog interrupting flow within extraction tube 112, components illustrated in FIG. 3, operate generally identically to system 200, as described above.

In the embodiments described above, both assist tube 106 and extraction tube 112 were generally stationary within container 102. Here, however, extraction tube 112 is mounted on spring mechanism 312, and an upstream tube 313 extends from spring mechanism 312 to vacuum source 114 (not shown). Spring mechanism 312 is widely known in the art, consisting of a lower portion attached to extraction tube 112 and an upper portion attached to upstream tube 313. The lower and upper portions of spring mechanism 312 can slide longitudinally with respect to each other, lengthening or shortening the distance between them. A coil spring 302 separates the two portions, biasing them in a relatively open position. By adding spring mechanism 312, extraction tube 112 can move vertically within assist tube 106.

Movement of spring mechanism 312 is accomplished by actuator 304, operating through a linkage 306. Actuator 304 applies force to the upper portion of spring mechanism 312 to move it downward, together with extraction tube 112, and it releases that pressure to allow coil spring 302 to return extraction tube 112 to its starting position. Those of skill in the art will recognize a number of well-known devices can embody actuator 304. One embodiment may employ a stepper motor for this purpose, for example. Likewise, linkage 306 can employ a suitable mechanical construction to convert rotary output of actuator 304 to a reciprocal vertical motion. An embodiment for accomplishing that result may employ a cam connected to a pivoted arm to accomplish that result. Numerous variations on these particular components will be apparent to those in the art.

Agitating structure 300 operates in a generally automatic manner, requiring notification from clog detector 202 to actuator 304 that agitation is required. That result can be accomplished through a number of means, most readily by a signal connection 305. As desired for various applications, clog detector 202 may directly provide an operating signal to actuator 304, or suitable control means may be provided. Those devices lie within the skill of those in the art.

Agitating structure 300 begins operation with the detection of a clog, typically an agglomeration 315 lodged at extraction inlet 116. As discussed above, that situation produces a pressure spike within extraction tube 112 and upstream tube 313, triggering a detection event at clog detector 202. Here, clog detector 202 reacts to the detection event by signaling actuator 304 via signal connection 305. In turn, actuator 304 operates through linkage 306 to apply a downward force to the upper portion of spring mechanism 312, driving extraction tube 112 toward closed end 106*b*. That action results in extraction tube 112 pressing against agglomeration 315, breaking it into individual solid-ink pellets 104. Continued operation of actuator 304 produces a release of pressure on the upper portion of spring mechanism 312, so that the restoring force of coil spring 302 returns that mechanism to its fully open position, retracting extraction tube 112 as well. In the illustrated embodiment, clog detector 202 continues to signal actuator 304 as long as a clog remains, and during that time, actuator 304 and linkage 306 impart a reciprocal vertical motion to spring mechanism 312. When the clog is cleared, clog detector 202 stops signaling and actuator 304 ceases operation.

It should be clear to those in the art that a number of variations and alternative embodiments can be introduced into agitating structure 300 to cope with a varied assortment of particular situations. For example, depending upon the exact consistency of solid-ink pellets 104, the distance between the low cycle point of extraction tube 112 and closed end 106*b* can be varied so that extraction tube 112 impresses more or less pressure on agglomeration 315. Similarly, both the speed and operating force applied by actuator 304 can be varied as desired.

As shown, agitating structure 300 operates automatically, but manual operation can be provided if desired. For a manual system, a suitable device for signaling an operator, such as indicator light 203 shown in FIG. 2, would replace signal connection 305. For a full manual operation, a simple handle could substitute for actuator 304 and linkage 306, allowing the operator to move spring mechanism 312 up and down as desired. For a semi-manual operation, actuator 304 and linkage 306 could remain in position, operated by a simple on-off switch or button (not shown).

Figure 4:
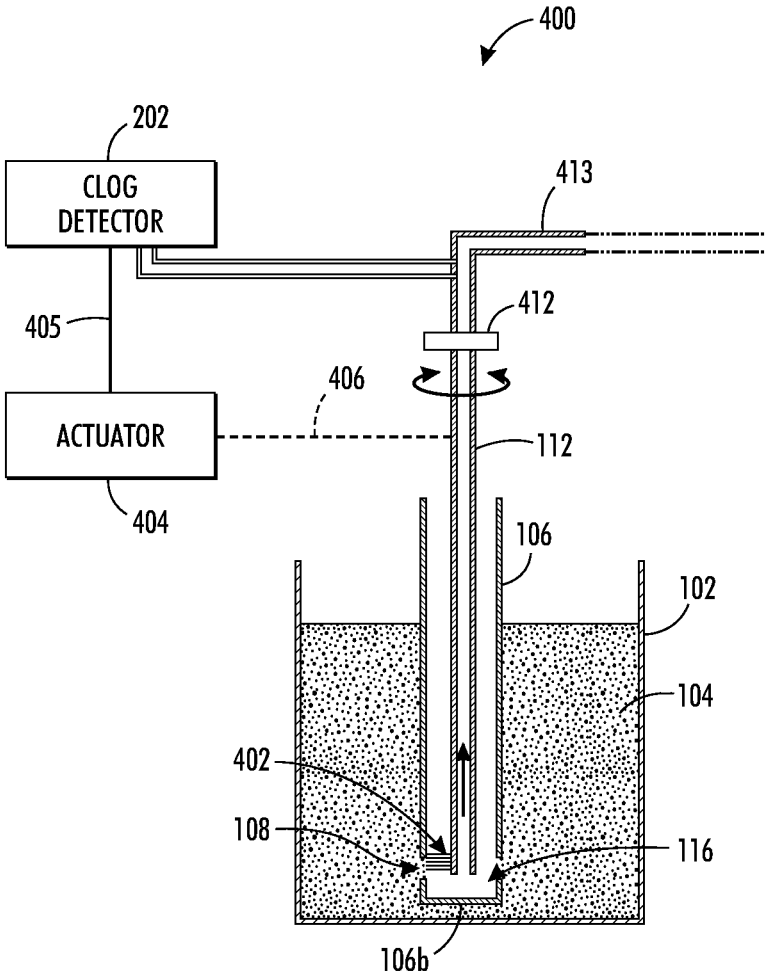
FIG. 4 illustrates an exemplary embodiment of an agitating system employing a brush.

FIG. 4 depicts an agitating structure 400 that employs a brush 402 to break up clumps close to inlet holes 108. As with previous embodiments, agitating structure 400 builds on previous embodiments, incorporating clog detector 202, an actuator 404, and extraction tube 112. Here, clog detector 202 operates exactly as discussed above, and actuator 404 responds to clog indications by signaling through a line 405. Here, however, extraction tube 112 is adapted for circular motion relative to an upstream tube 413 through the action of a rotating fitting 412, which permits the free rotation of extraction tube 112. As shown, actuator 404, through a linkage 406, drives extraction tube 112. As desired, actuator 404 and linkage 406 can be configured to provide a continuous or reciprocal rotating movement.

Agitating structure 400 operates to clear clogs through the actions of brush 402 mounted at the tip of extraction tube 112, near extraction inlet 116. In the illustrated embodiment, brush 402 consists of a number of bristles extending generally perpendicular to extraction tube 112, of sufficient length to engage the inner sidewalls of assist tube 106. Brush 402 lies generally level with inlet holes 108, so that the bristles engage inlet holes 108. Only one set of bristles appears in FIG. 4, but a designer could provide as many sets of bristles as desired. It has been found that three or four sets of bristles seem to provide an optimal solution. Additionally, it appears desirable to size bristle length slightly longer than the exact distance from extraction tube 112 to assist tube 106 inner sidewall, so that bristles extend at least slightly into inlet holes 108. That sizing allows the bristles to clear inlet holes 108 of any agglomerations while also providing for extended bristle life. Brush 402 may be constructed of any suitable material, with bristles formed of a resilient material having sufficient stiffness to engage and break up agglomerations. Nylon, plastics, and similar materials have been found effective materials from which to construct brush 402. Likewise, mounting brush 402 on extraction tube 112 lies well within the skill of the art.

Agitating structure 400 operates in a manner similar to structures discussed above. Upon clog identification, clog detector 202 signals actuator 404 via line 405 to initiate agitation of pellet agglomerations blocking inlet holes 108. Actuator 404 , acting through linkage 406, starts rotation of extraction tube 112, which in turn causes brush 402 to rotate within assist tube 106. Brush 402 wipes the inner surface of assist tube 106 including inlet holes 108, breaking any pellet agglomerations blocking inlet holes 108. It should be understood that at any instant during the circular motion, sets of bristles of brush 402 may only block one inlet hole, leaving remaining holes open. Alternatively, if brush 402 is substantially narrower than the width of inlet holes 108, all four inlet holes may be open at any instant to receive stored pellets. Actuator 404 may rotate extraction tube 112 continuously, at a predetermined time interval, or on agglomerate identification. In addition, actuator 404 and linkage 406 may be configured to provide reciprocal rotary movement, restricted in extent so that the bristles of brush 402 remain inserted into inlet holes 108.

The embodiments discussed in connection with FIGS. 3 and 4 illustrate agitating structures that remove obstructions near extraction inlet 116 and adjacent to inlet holes 108, respectively. The present disclosure may also remove obstructions simultaneously from both locations, by combining the reciprocal vertical movement of spring mechanism 312 and the rotation of brush 402, in an embodiment. In such an embodiment, an actuator may act through appropriate linkages to initiate vertical and rotary motion simultaneously. Alternatively, clog detector 202 may visually indicate the presence of a clog, allowing an operator to manually rotate or vertically move extraction tube 112, either continuously or periodically. These and other modifications of agitating structure 400 will be apparent to those in the art.

Figure 5A:
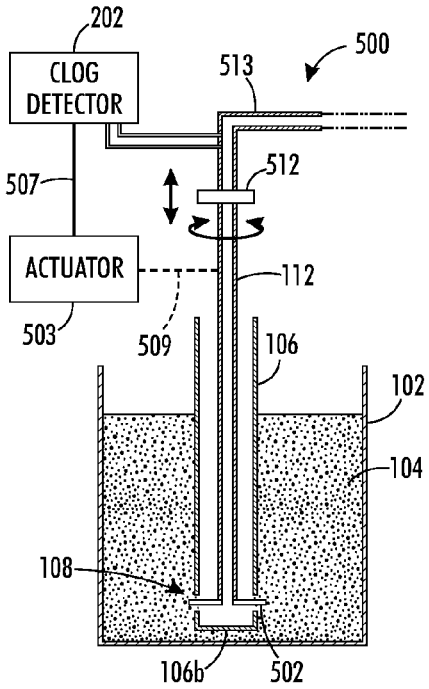
FIGS. 5A, 5B, and 5C show an embodiment of the present disclosure employing a set of wires.
Figure 5B:
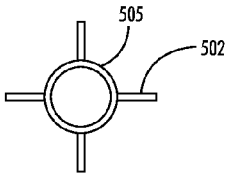
Figure 5C:
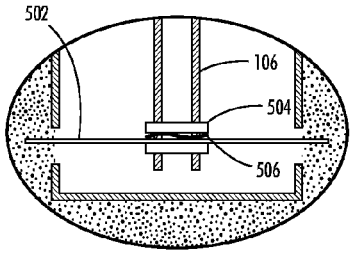

FIGS. 5A, 5B, and 5C illustrate an alternative embodiment, in which an agitating structure 500 employs a set of wires 502 and an actuator 503 for breaking up agglomerations blocking inlet holes 108. Agitating structure 500 operates in a manner similar to that discussed previously, with clog detector 202 detecting and signaling a pressure spike within extractor tube 112 and an upstream tube 513. Likewise, actuator 503 receives the clog detection signal through a line 507. Similarly, extraction tube 112 is adapted for rotary motion by connecting it to a rotating fitting 512. Actuator 503 acts through a linkage 509 to drive extraction tube 112 in continuous or reciprocal rotary motion.

Agitating structure 500 employs a set of wires to break up agglomerations near inlet holes 108 and extraction inlet 116. As shown in FIG. 5A, wires 502 are mounted at the bottom of extraction tube 112 and extend perpendicularly outward for a distance sufficient to protrude through inlet holes 108. The illustrated embodiment provides one wire for each inlet hole; fewer wires may be provided, but such a design would forgo clog clearance where no wire was present. In general, wires 502 are sufficiently thin to avoid restricting pellet flow through inlet holes 108. Further, wires 502 are sufficiently resilient to bend without deforming, preventing damage if actuator 503 over rotates extraction tube 112 so that individual wires may contact with the end of inlet holes 108. In one embodiment of the wires, shown in FIG. 5B, wires 502 are formed from a single stamped metal part, which employs a material sufficiently rigid to break up the agglomerates.

It can be noted from inspection of FIGS. 5A and 5B that inlet holes 108 provided in agitating structure 500 may be formed as elongated slots, permitting wires 502 to move in reciprocal rotation within the openings. Additionally, inlet holes 108 may be provided with sufficient vertical dimension that extraction tube 112 can move in vertical reciprocal motion, as discussed in connection with FIG. 3.

Wires 502 can be attached to extraction tube 112 using a number of conventional devices, such as a span fit attachment, a friction joint, or other suitable attachment means. For a span fit attachment, wires 502 are connected to a ring-shaped structure 505, as shown in FIG. 5B, whose diameter is sized to slide over and span extraction tube 112. In another implementation, illustrated in FIG. 5C, wires 502 may be connected to extraction tube 112 using a spring (not shown) or a wave washer 506 that provides a friction fit. Wires 502 and wave washer 506 may be retained at a desired position using a set of clamp rings 504 surrounding the wire attachment. Moreover, torque produced by actuator 503 during the activation of extraction tube 112 may be limited by wave washer 506, avoiding wire breakage.

The extent of both vertical and rotary movement provided by actuator 503 and linkage 509 is carefully regulated in this embodiment to avoid damaging wires 502. Those in the art will understand suitable methods for controlling actuator 503 to accomplish that result. Alternatively, mechanisms such as wave washer 506, discussed above, may be employed to prevent damage to wires 502 in the event of over rotation.

Operation of agitating structure 500 proceeds in a fashion similar to that previously discussed. Upon identifying a clog, clog detector 202 signals actuator 503 via line 507 to initiate motion of extraction tube 112. Based on the exact type and extent of motion desired, as reflected in configuration of the embodiment, actuator 503 and linkage 509 cooperate to produce a desired degree and tempo of reciprocal rotary or vertical motion, or a combination of the two. This motion is restricted to an extent that precludes wires 502 from making contact with the sides of inlet holes 108. The reciprocating motion causes wires 502 to move across inlet holes 108, breaking up agglomerations and clearing any flow barriers.

Figure 6A:
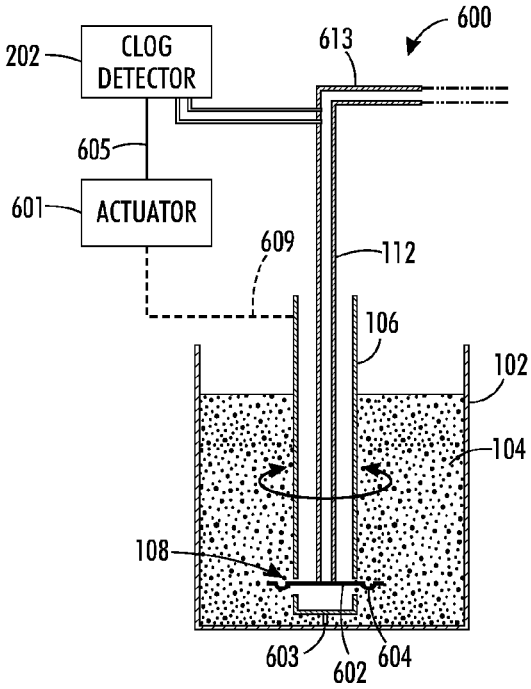
FIGS. 6A, 6B, and 6C show another embodiment implementing a pair of substantially perpendicular wires.
Figure 6B:
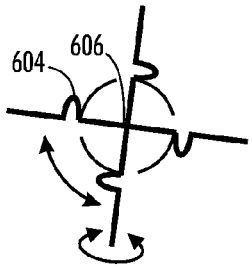
Figure 6C:
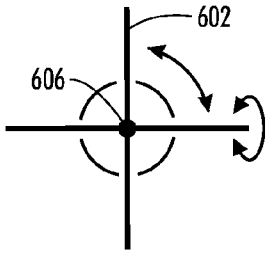

FIGS. 6A, 6B, and 6C illustrate an agitating structure 600, an embodiment that adds a pair of substantially perpendicular wires 602 to extraction tube 112. Here, contrary to previous embodiments, extraction tube 112 remains stationary while assist tube 106 rotates. Agitating structure 600 once clog detector 202 detects and signals a pressure spike within extractor tube 112 and an upstream tube 613. Rotation is accomplished by the action of an actuator 601, acting through a linkage 609 to rotate assist tube 106 in either reciprocal or continuous movement.

Agitating structure 600 breaks up agglomerations in the vicinity of inlet holes 108 through the action of a set of wires 602. As shown, the two wires 602 are mounted at the bottom of extraction tube 112 and extend outward through inlet holes 108. The two wires 602 meet at a crossover point 606, with no rigid connection between the two. In general, wires 602 are substantially thin wires such that they do not restrict the flow of pellets 104 from inlet holes 108.

To prevent wires 602 from slipping out of assist tube 106, a retention mechanism may be employed. As shown in FIG. 6B, each wire 602 includes a retention mechanism in the form of a kink 604 formed in each wire just outside inlet holes 108. Each kink is angled such that kinks 604 remains outside assist tube 106, preventing the wires from slipping out of assist tube 106. In addition, wires 602 are sized to permit a smooth flow of pellets 104 through inlet holes 108.

Agitating structure 600 operates in a manner similar to the embodiments previously discussed. Once a clog is identified, clog detector 202 directs actuator 601, through a signal line 605, to initiate rotation of assist tube 106. Rotation proceeds through the action of actuator 601 through linkage 609, which reciprocally rotates assist tube 106 about a pivot point 603. That movement causes wires 602 to move back and forth within inlet holes 108, breaking up any agglomerations near inlet holes 108. Breaking up clogs allows smooth passage of pellets 104 entering through inlet holes 108.

FIG. 6C illustrates an alternative of the retention mechanism, in which the pair of wires 602 are connected at crossover point 606. Crossover point 606 may substantially coincide with the longitudinal axis and center of extraction tube 112, preventing wires 602 from slipping out of assist tube 106 through inlet holes 108. As already discussed, the ends of wires 602 extend out from assist tube 106 through inlet holes 108. Wires 602 may be manufactured from stainless steel with a thickness sufficient to provide a stirring action in the midst of the pellets. Other suitable materials may be employed without departing from the scope of the present disclosure.

In the illustrated embodiments of system 200, the width of inlet holes 108 depends on the size of solid-ink pellets 104, which is typically about 2 mm. In general, inlet holes 108 are structured with a clearance greater than the size of solid-ink pellets 104 in order to allow transportation of pellets 104. Thus, the slots of the illustrated embodiment have a width of about 8 mm.

As can be seen, the agitating structures or systems described in various embodiments (FIGS. 3-6) and implementations are arranged to encounter minimal resistance from solid-ink pellets 104, minimizing torque requirements from the respective actuators. Alternatively, the various agitating structures may include other suitable structural geometries, such as blades, sheet metal, or pins, that may dislodge solid-ink pellets 104 with minimum torque required.

The geometry and the movement of the agitating structures may depend on the properties of the particular solid-ink pellets 104 employed in a given implementation. Relevant parameters can include bulk density, size range, melting point, static charge, flowability and so on. Further, assist tube 106 and extraction tube 112 can be tailored to these properties; for example, the diameter of extraction tube 112 may be based on the size range of solid-ink pellets 104 being extracted.

It will be apparent to those of skill in the art that a number of structural variations can be introduced to agitate and break up agglomerations. For example, the actuator (described in various embodiments) may be operatively coupled to the agitating structure (such as wires, brushes, or the like) but not to extraction tube 112, so that the actuator only rotates the agitating structure. Alternatively, multiple agitating structures may be introduced in container 102, all driven by an actuator. Further, the agitating structure may only include a brush or wires to break up pellet agglomerations.

In addition, actuators 304, 404, and 503 are disclosed as being individually connected to extraction tube 112; it should be apparent, however, that these actuators may be a part of the image-forming device or container 102 and may be detachably connected to extraction tube 112. The actuators may include a drive motor or an air cylinder. The process of introducing vertical and/or rotary movement in a structure, such as extraction tube 112, using an actuator is known to those skilled in the art and is not explained in detail. In the illustrated embodiments, the actuators may substantially move the actuator arm about the longitudinal axis and/or about the circumference of extraction tube 112, breaking up the flow barriers with minimum torque. A torque value of 5 N-m generated by the actuators may be sufficient to break up the pellet agglomerations.

Additionally, those in the art will understand that embodiments of the present disclosure will be suitable for performing agitation and clog detection functions in implementations that deal with any manner of pelletized, pellet-like, or particulate matter. The particular details of clog detection and mitigation will differ for each environment, but those of skill in the art will understand the specific variations required in each situation.

Figure 7:
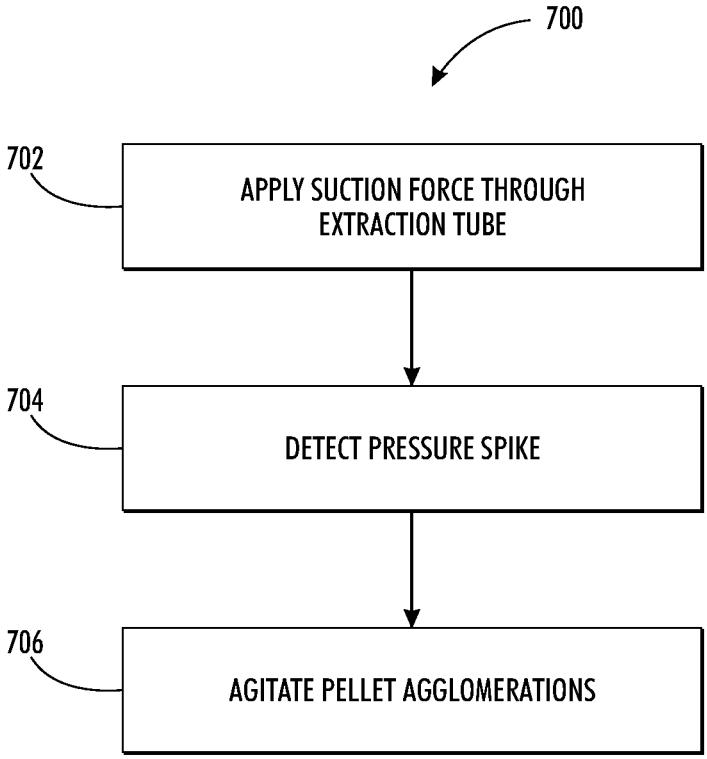
FIG. 7 is a flowchart of an exemplary method for detecting clogging and breaking pellet agglomerations for delivering solid-ink pellets to an image-forming device.

FIG. 7 is a flowchart of an exemplary method 700 for detecting clogging and breaking pellet agglomerations in an image-forming device. The process begins when vacuum source 114 applies a suction force to extraction tube 112. That suction induces an airflow 120 flowing from inlet holes 108 of assist tube 106, into extraction tube 112, and on to vacuum source 114. In the vicinity of the tip of extraction tube 112, extraction inlet 116, airflow 120 passes by inlet holes 108, where the low pressure within assist tube 106 impels pellets 104 through inlet holes 108, where they become entrained in airflow 120.

Pellets 104 in the vicinity of inlet holes 108 may have agglomerated into clumps or agglomerations, owing to the processes discussed above. Where, as shown in FIG. 3, agglomeration 315 exceeds the size of the opening end of extraction tube 112, near extraction inlet 116, the agglomeration will lodge in the opening, producing a clog. That blockage impedes or stops airflow, producing an immediate pressure spike within extraction tube 112. Pressure spikes are quickly detected by clog detector 202, as shown in step 704.

After detecting a clog, the system proceeds to step 706, where it begins to employ an agitating structure to break up the agglomerations. Specific examples of agitating structures are described in FIGS. 3-6. Various combinations of such structures are useful for breaking agglomerates.

As explained above, a variety of devices can embody the processes of detecting clogs and mitigating their effects. Moreover, the specific steps employed in such processes may vary in order of timing, or exact manner of implementation. Those of skill in the art will understand effective techniques adapted to particular situations.

It should be noted that the description below does not set out specific details of manufacture or design of the various components. Those of skill in the art are familiar with such details, and unless departures from those techniques are set out, techniques, designs and materials known in the art should be employed. Those in the art are capable of choosing suitable manufacturing and design details.

The terminology used herein describes particular embodiments only; considerable variation is anticipated in implementation. It will be appreciated that several of the disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for maintaining flowability of solid-ink pellets during suction-induced flow from a container to an image-forming device, the apparatus comprising:

an extraction tube inserted into the container, the extraction tube being in fluid communication with a vacuum source;

mounted for reciprocal vertical motion within the container;

and further including a spring mechanism mounted on the extraction tube to bias the extraction tube at the top end in the extraction tube's range of vertical motion; and an extraction inlet, sized for receiving the pellets;

a clog detector connected to the extraction tube for sensing changes in vacuum level within the extraction tube to identify clogging; and an agitating structure, responsive to the clog detector, for breaking up pellet agglomerations.

2. The apparatus of claim 1, further comprising:

an actuator, operatively connected to the clog detector; and a linkage, operatively joining the actuator and the spring mechanism, wherein the actuator and the linkage are configured to impart reciprocal vertical force on the spring mechanism.

3. An apparatus for maintaining flowability of solid-ink pellets during suction-induced flow from a container to an image-forming device, the apparatus comprising:

an extraction tube inserted into, and mounted for rotary motion within, the container, the extraction tube being in fluid communication with a vacuum source and the extraction tube further including an extraction inlet, sized for receiving the pellets;

a clog detector connected to the extraction tube for sensing changes in vacuum level within the extraction tube to identify clogging;

an assist tube encompassing the extraction tube, the assist tube having inlet holes formed therein, sized for receiving pellets and an agitating structure, responsive to the clog detector, for breaking up pellet agglomerations and wherein the agitating structure includes a brush perpendicularly mounted on the extraction tube near the extraction inlet, the brush including one or more sets of bristles extending at least between the extraction tube and the inner wall of the assist tube, the bristles being positioned to extend into the inlet holes;

the extraction tube is mounted for rotary motion within the container; and the agitating structure includes a brush perpendicularly mounted on the extraction tube near the extraction inlet, the brush including one or more sets of bristles extending at least between the extraction tube and the inner wall of the assist tube, the bristles being positioned to extend into the inlet holes.

4. The apparatus of claim 3, further including an actuator, operatively connected to the clog detector; and a linkage, operatively joining the actuator and the spring mechanism, wherein the actuator and the linkage are configured to impart rotary motion to the extraction tube.

5. The apparatus of claim 4, wherein the imparted rotary motion is reciprocal and the extraction tube is configured to rotate an angular distance sufficient to cause the brush to traverse the inlet holes.

6. An apparatus for maintaining flowability of solid-ink pellets during suction-induced flow from a container to an image-forming device, the apparatus comprising:

an extraction tube inserted into, and mounted for rotary motion within, the container, the extraction tube being in fluid communication with a vacuum source and the extraction tube further including an extraction inlet, sized for receiving the pellets;

a clog detector connected to the extraction tube for sensing changes in vacuum level within the extraction tube to identify clogging;

an assist tube encompassing the extraction tube, the assist tube having inlet holes formed therein, sized for receiving pellets and an agitating structure, responsive to the clog detector, for breaking up pellet agglomerations and wherein the agitating structure includes a plurality of wires mounted on the extraction tube and extending perpendicularly outward for a distance sufficient to protrude through the inlet holes.

7. The apparatus of claim 6, further including an actuator, operatively connected to the clog detector; and a linkage, operatively joining the actuator and the spring mechanism, wherein the actuator and the linkage are configured to impart rotary motion to the extraction tube.

8. The apparatus of claim 7, wherein the imparted rotary motion is reciprocal and is configured to rotate an angular distance sufficient to cause each wire to traverse an inlet hole.

9. An apparatus for maintaining flowability of solid-ink pellets during suction-induced flow from a container to an image-forming device, the apparatus comprising:

an extraction tube inserted into the container, the extraction tube being in fluid communication with a vacuum source and the extraction tube further including an extraction inlet, sized for receiving the pellets;

a clog detector connected to the extraction tube for sensing changes in vacuum level within the extraction tube to identify clogging; and an agitating structure, responsive to the clog detector, for breaking up pellet agglomerations;

wherein the agitating structure includes a plurality of perpendicular wires placed along the diametrically opposite inlet holes, wires having projections on either end such that the projections extend outward from the inlet holes.

10. An apparatus for maintaining flowability of solid-ink pellets during suction-induced flow from a container to an image-forming device, the apparatus comprising:

an extraction tube mounted for reciprocal vertical motion within the container and in fluid communication with a vacuum source and the extraction tube, wherein the extraction tube further includes an extraction inlet, sized for receiving pellets; and a spring mechanism mounted on the extraction tube to bias the extraction tube at the top end in the extraction tube's range of vertical motion;

an agitating structure, for breaking up pellet agglomerations, and an assist tube encompassing the extraction tube, the assist tube having inlet holes formed therein, sized for receiving pellets.

11. The apparatus of claim 10, further including an actuator; and a linkage, operatively joining the actuator and the spring mechanism, wherein the actuator and the linkage are configured to impart reciprocal vertical force on the spring mechanism.

12. An apparatus for maintaining flowability of solid-ink pellets during suction-induced flow from a container to an image-forming device, the apparatus comprising:

an extraction tube mounted for rotary motion within the container and in fluid communication with a vacuum source, wherein the extraction tube further includes an extraction inlet, sized for receiving pellets;

an agitating structure, for breaking up pellet agglomerations, the agitating structure including a brush perpendicularly mounted on the extraction tube near the extraction inlet, the brush including one or more sets of bristles extending at least between the extraction tube and the inner wall of the assist tube, the bristles being positioned to extend into the inlet holes; and an assist tube encompassing the extraction tube, the assist tube having inlet holes formed therein, sized for receiving pellets.

13. The apparatus of claim 12, further including an actuator; and a linkage, operatively joining the actuator and the spring mechanism, wherein the actuator and the linkage are configured to impart rotary motion to the extraction tube.

14. The apparatus of claim 13, wherein the imparted rotary motion is reciprocal and the extraction tube is configured to rotate an angular distance sufficient to cause the brush to traverse the inlet holes.

15. An apparatus for maintaining flowability of solid-ink pellets during suction-induced flow from a container to an image-forming device, the apparatus comprising:

an extraction tube, mounted for rotary within the container and in fluid communication with a vacuum source, the extraction tube further including an extraction inlet, sized for receiving pellets;

an agitating structure, for breaking up pellet agglomerations the agitating structure including a plurality of wires mounted on the extraction tube and extending perpendicularly outward for a distance sufficient to protrude through the inlet holes; and an assist tube encompassing the extraction tube, the assist tube having inlet holes formed therein, sized for receiving pellets.

16. The apparatus of claim 15, further including an actuator; and a linkage, operatively joining the actuator and the spring mechanism, wherein the actuator and the linkage are configured to impart rotary motion to the extraction tube.

17. The apparatus of claim 16, wherein the imparted rotary motion is reciprocal and the extraction tube is configured to rotate an angular distance sufficient to cause each wire to traverse an inlet hole.

18. An apparatus for maintaining flowability of solid-ink pellets during suction-induced flow from a container to an image-forming device, the apparatus comprising:

an extraction tube inserted into the container, the extraction tube being in fluid communication with a vacuum source and the extraction tube further including an extraction inlet, sized for receiving the pellets;

a clog detector connected to the extraction tube for sensing changes in vacuum level within the extraction tube to identify clogging; and an agitating structure, responsive to the clog detector, for breaking up pellet agglomerations;

wherein the agitating structure includes a plurality of perpendicular wires placed along the diametrically opposite inlet holes, wires having projections on either end such that the projections extend outward from the inlet holes.

* * * * *